US006557284B2

(12) United States Patent
Nolan

(10) Patent No.: US 6,557,284 B2
(45) Date of Patent: May 6, 2003

(54) BACKLIT DISPLAY APPARATUS

(76) Inventor: Steven T. Nolan, 4260 Arthur La., Beaumont, TX (US) 77706

( * ) Notice: Subject to any disclaimer, the term of this patent is extended or adjusted under 35 U.S.C. 154(b) by 0 days.

(21) Appl. No.: 09/940,145

(22) Filed: Aug. 27, 2001

(65) Prior Publication Data

US 2003/0037472 A1 Feb. 27, 2003

(51) Int. Cl.[7] ..... G09F 13/04
(52) U.S. Cl. ..... 40/574; 40/578
(58) Field of Search ..... 40/564, 575, 574, 40/578, 593; 362/812

(56) References Cited

U.S. PATENT DOCUMENTS

| | | | | | |
|---|---|---|---|---|---|
| 2,029,221 | A | * | 1/1936 | Burgess et al. | 362/812 |
| 3,771,245 | A | | 11/1973 | Mabrey et al. | |
| 3,935,654 | A | | 2/1976 | Rubin | |
| 4,070,779 | A | * | 1/1978 | Gilmour | 40/573 |
| 4,139,957 | A | | 2/1979 | Minogue | |
| 4,169,327 | A | * | 10/1979 | Stilling | 40/549 |
| 4,756,108 | A | * | 7/1988 | Lackey et al. | 40/585 |
| 4,805,324 | A | | 2/1989 | Anderson | |
| 5,457,905 | A | * | 10/1995 | Kaplan | 40/574 |
| 5,615,501 | A | | 4/1997 | Rice | |
| 5,678,334 | A | | 10/1997 | Schoniger | |
| 5,826,973 | A | | 10/1998 | Melzian et al. | |
| 5,870,110 | A | * | 2/1999 | Mallory | 345/168 |
| 6,043,591 | A | | 3/2000 | Gleckman | |
| 6,079,136 | A | * | 6/2000 | Kozlarek | 224/519 |
| 6,105,291 | A | * | 8/2000 | Gabrius et al. | 40/572 |
| 6,154,994 | A | * | 12/2000 | O'Brien et al. | 362/812 |
| 6,158,156 | A | | 12/2000 | Patrick | |

* cited by examiner

*Primary Examiner*—Brian K. Green
(74) *Attorney, Agent, or Firm*—Ronald D. Homburg

(57) ABSTRACT

A backlit display apparatus mounts to an exterior surface, including an automobile, wherein plain paper designs, digital photographs on plain paper or transparencies may be displayed between a white translucent dispersing panel and a clear front panel, with the front panel and the dispersing panel having a weather-proof seal. A high lumen light source, which could consist of a single bulb or a plurality of low lumen light sources, is located behind the dispersing panel, powered by either an internal DC electrical power source, an external DC electrical power source or an external 110 volt AC power source, the high lumen light source having a variable illumination control mechanism to select from a constant illumination, a flashing illumination or a passive illumination, such passive illumination derived from the external power source, including the brake light electrical system or the running light electrical system of an automobile to which the apparatus may be attached.

3 Claims, 3 Drawing Sheets

BACKLIT DISPLAY APPARATUS

CROSS REFERENCE TO RELATED APPLICATIONS

None

I. BACKGROUND OF THE INVENTION

1. Field of Invention

The invention is a backlit display apparatus, mountable to an exterior surface, including an automobile, wherein plain paper designs, digital photographs on plain paper or transparencies may be displayed between a white translucent dispersing panel and a clear front panel, with the front panel and the dispersing panel having a weather-proof seal. A high lumen light source, which could consist of a single bulb or a plurality of low lumen light sources, is located behind the dispersing panel, powered by either an internal DC electrical power source, an external DC electrical power source or an external 110 volt AC power source, the high lumen light source having a variable illumination control mechanism to select from a constant illumination, a flashing illumination or a passive illumination, such passive illumination derived from the external power source, including the brake light electrical system or the running light electrical system of an automobile to which the apparatus may be attached.

2. Description of Prior Art

The following United States patents were discovered and are disclosed within this application for utility patent. All relate to lighted display devices. However, none of them denote a white translucent back-lighted screen which would allow material or media displayed on plain white paper to be displayed with clarity.

A display medium for large color transparencies was disclosed in U.S. Pat. No. 3,771,245 to Mabrey, et al. A translucent adhesive is used in this device to attach the color transparency to the inner glass of the device. Transparent and translucent devices are displayed using the device disclosed in U.S. Pat. No. 3,935,654 to Rubin, such device attached to a vehicle for display of the attached signage. Low voltage lights mounted to a truncated sawtooth metal back frame are disclosed in U.S. Pat. No. 4,139,957 to Minogue which is used to display transparent or translucent signs.

Light signs are disclosed in U.S. Pat. No. 4,805,324 to Anderson and U.S. Pat. No. 5,678,334 to Schoniger. Neither utilize any translucent back-lighted panels. An illuminated license plate or illuminated display panel are noted and disclosed in U.S. Pat. No. 5,615,501 to Rice.

In U.S. Pat. No. 5,826,973 to Melzian, et al., discloses a translucent plate or white plate positioned between a reflector and light source and the housing of the device to display a photographic print, a slide, a negative, a sheet of paper or other similar objects. This device is not adapted for use in an external environment, as no weather resisting seal is identified to protect the displayed media from the elements encountered in exterior use. This device also disclosed no adaptable use for display on an automobile nor adapted means to utilize the low voltage present in an automobile's electrical system, as does the current invention.

II. SUMMARY OF THE INVENTION

The primary objective of the invention is to provide a low voltage display apparatus utilizing a white translucent back-lighted screen to display colored photographic prints or messages on plain white paper, messages and pictures on transparent film media and other artwork on plain paper which attaches to a flat surface of an automobile, building or any other exterior flat surface, the apparatus having a weather proof seal between the white translucent back-lighted screen and a clear front transparent screen. The current device also presents a means of utilizing the low voltage current of an automobile to which it may attach. None of the prior art patents incorporate all these features in a singular device, nor can their combined prior art elements produce the present device.

Almost every prior art patent requires the image to be displayed to be imprinted or laminated onto clear plastic material or a lens which is located directly in front of light bulbs. This generally requires use of a professional print shop, which is generally not available for home production or use. In order for an image to be displayed, the sections which are white are transferred onto this medium as clear. When the light is directed through this display medium, the image seen is severely distorted by the direct unfiltered light through the clear portion of the image being displayed. Ordinary copy paper cannot be used, because it tends to become dark and images printed in dark color on this medium tend to lose their color because of the density of the ink in contrast to lighter colors.

The present invention, in using the white translucent display panel between the high lumen light source and the display image allows for production of display medium using a simple home computer printer on white paper. The white translucent display panel evenly disperses the light from the high lumen light source and also maintains the integrity of the colors. White actually appears white and is of an even intensity, reducing bright spots through the display medium. Colors experience less darkening and distortion due to the white translucent display panel maintaining a uniform light dispersion back-lighted image. Childrens artwork, digital photographs on white paper, transparencies or text messages can all be displayed with clear visual accuracy of the printed or displayed subject matter.

In addition, this device is adaptable for use on an automobile using the automobile's 12 volt DC electrical system and can be set to activate along with the break lights, turn signals or running light or adaptable for attachment to a building wall or window, indoors or outdoors, using a 110 volt AC power source for display of photographs, text or any other medium included on white paper produced on any computer printer. If no power supply is readily available, the device also has an internal DC power supply to illuminate the high lumen light source.

III. DESCRIPTION OF THE DRAWINGS

The following drawings are submitted with this utility patent application.

Figure 3:
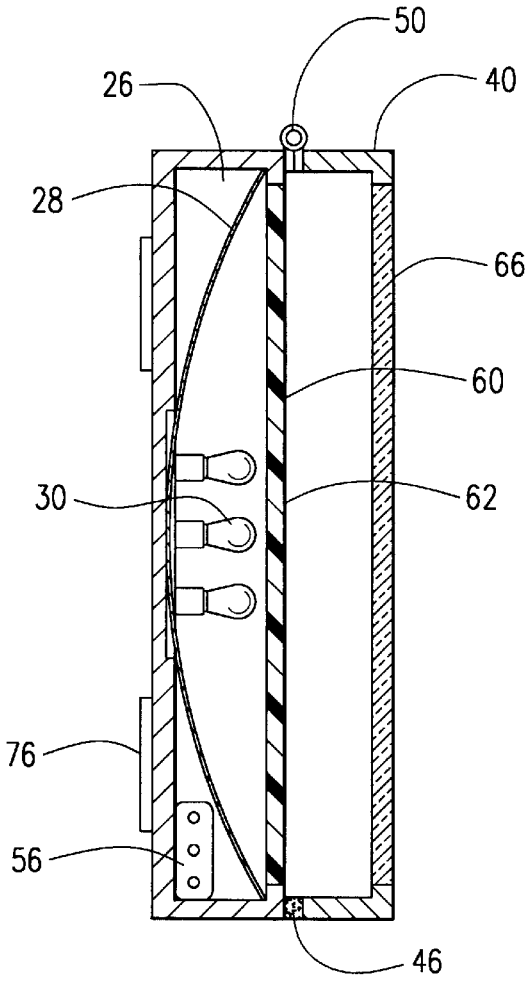

FIG. 3 a view of the device during the insertion of an picture or graphic work to be displayed.

Figure 4:
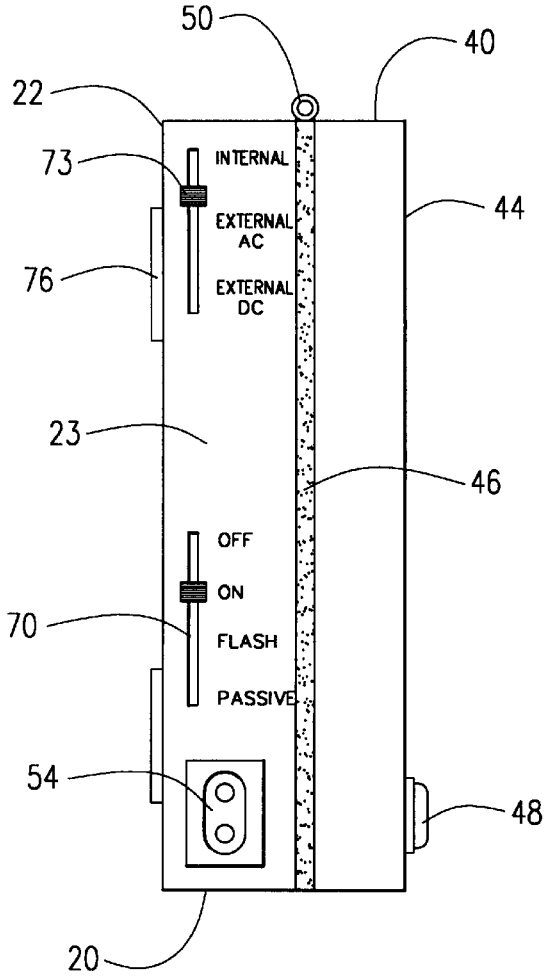

FIG. 4 is a drawing of some of the possible electrical attachment means included in the device.

Figure 5:
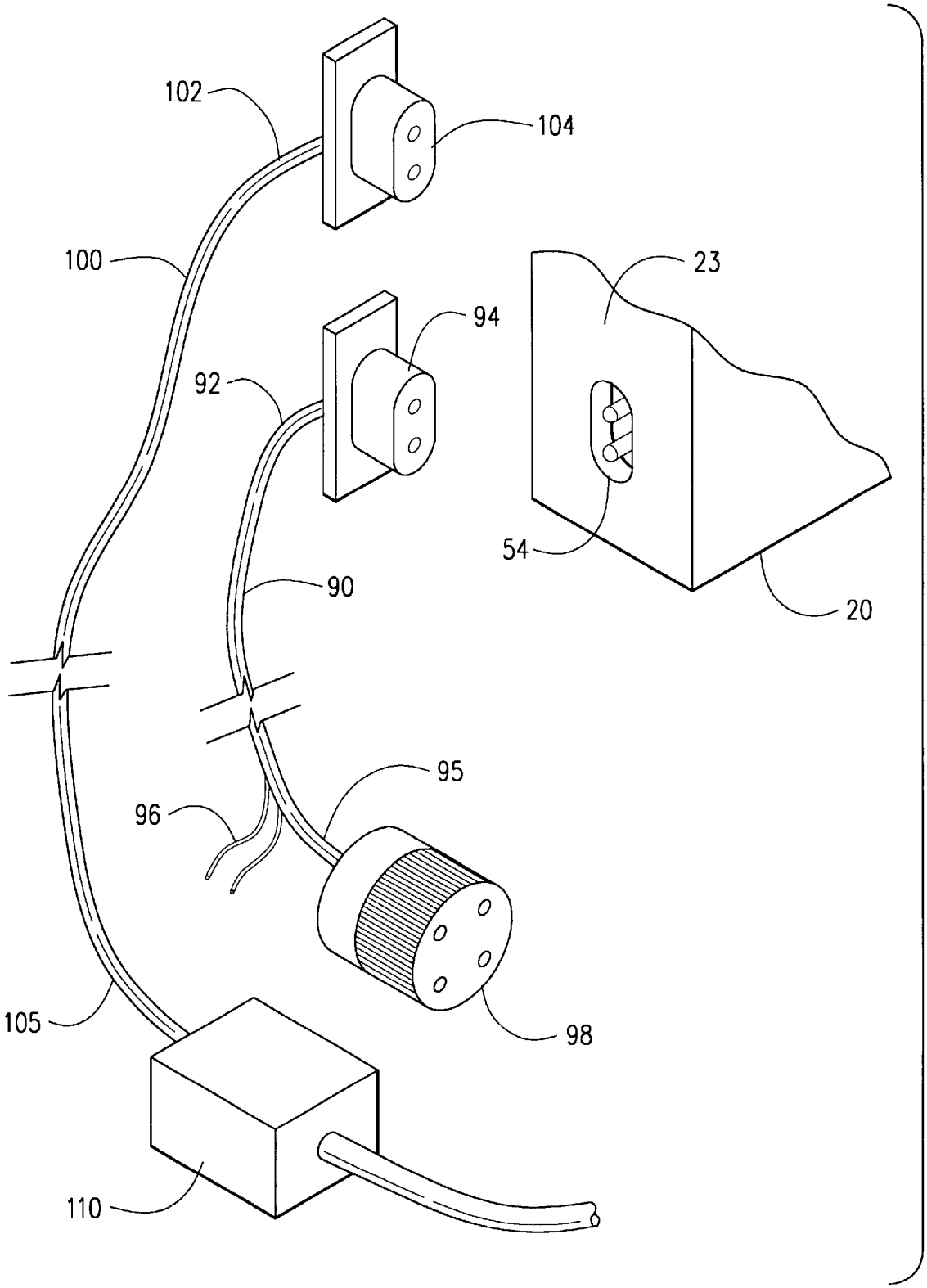

FIG. 5 is a side view of the invention indicating the power selection switch and display mode switch.

IV. DESCRIPTION OF THE PREFERRED EMBODIMENT

The invention, as shown in FIGS. 1–5 of the drawings, is an exterior back-lighted display device for display of transparent or plain white paper printed medium on an exterior surface, the device 10 comprising essentially abase frame 20, a hinged front frame 40, a high lumen light source 30, a white translucent display panel 60, a weather resistant transparent cover panel 66, a means 70 of selection of a lighting sequence, a means 73 of selection of a power source, at least one electronic connection 80 to a power source and a means 76 of removable attachment to a flat and relatively vertical exterior surface.

Figure 1:
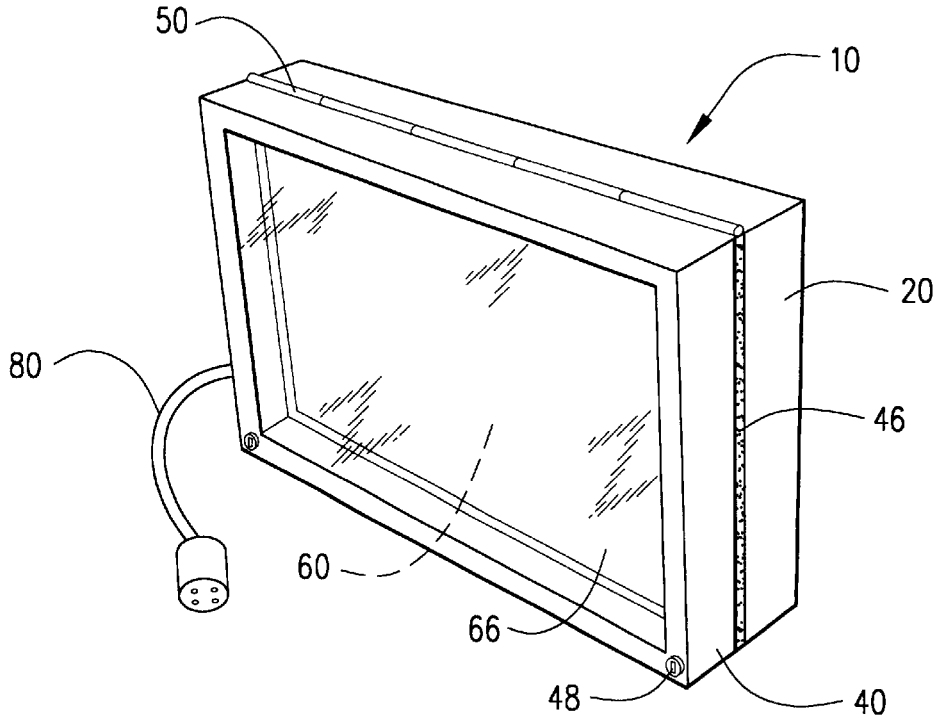
FIG. 1 is a front perspective of the device attached to a vehicle surface.
Figure 2:
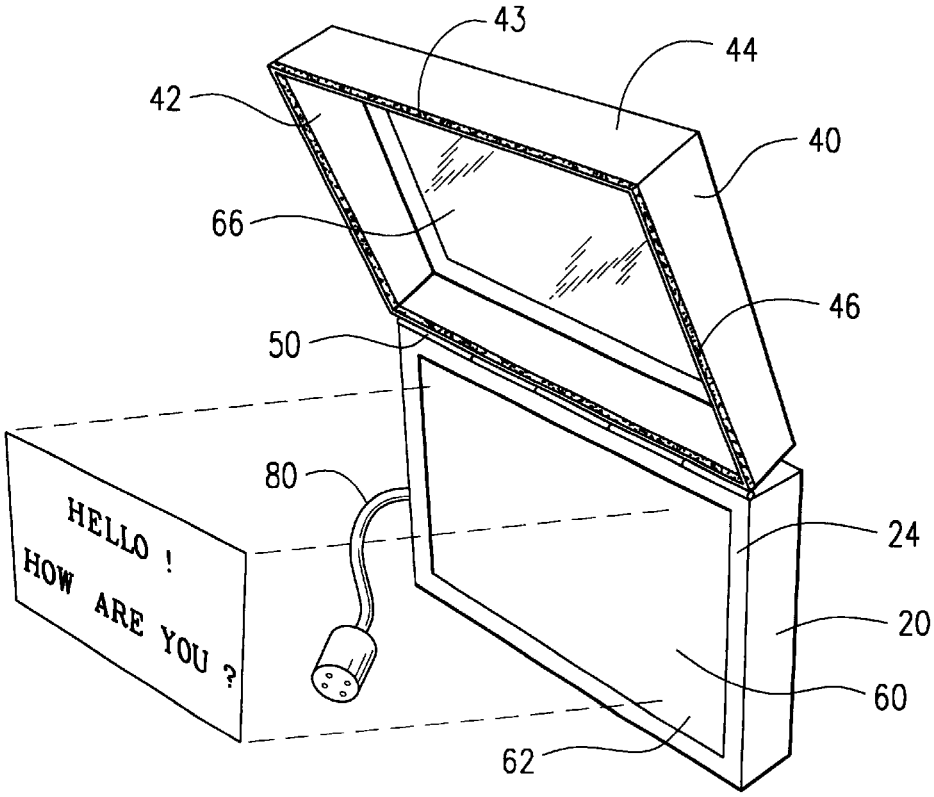
FIG. 2 is a side cross-sectional view of the device.

The base frame 20 of the device, shown in FIGS. 2 and 3 of the drawings, further includes a back portion 22, side portions 23 and a front perimeter rim 24 defining an inner cavity 26. The inner cavity 26 contains a concave reflective insert 28 in front of which is oriented the high lumen light source 30. The white translucent display panel 60 is attached within the inner cavity 26 in front of the high lumen light source 30, thus providing a back-lighted surface 62 upon which the transparent or plain white paper printed medium is displayed. Such attachment of the white translucent display panel 60 to the inner cavity 26 of the base frame 20 may be accomplished using a plurality of screws or by the inclusion of a slide channel in the base frame 20 accepting the white translucent display panel 60 thereby allowing access to the inner cavity 26 for periodic maintenance or repair to the device 10.

Also included within the inner cavity 26, preferable behind the concave reflective insert 28, but partially projecting through at least one side portion 23, are the means 70 of selection of a lighting sequence, the means 73 of selection of a power source, and an electrical socket 54, as shown in FIG. 4 of the drawings. The electrical socket 54 is connected to the high lumen light source 30 through the means 70 of selection of a lighting sequence and the means 73 of selection of a power source. The high lumen light source 30 may be supplied by a single bulb, or it may be supplied by a plurality of low lumen light sources cumulatively.

The means 70 of selection of a lighting sequence allows for a choice of selecting a constant on, a constant off, a sequential flashing or a passive mode for controlling the illumination of the high lumen light source 30. The passive mode of the means 70 of selection of the lighting sequence places the illumination of the high lumen light source 30 in response to an external power source, which, in one embodiment, may be an automobile taillight electrical system, causing illumination of the high lumen light source 30 to activate as the brake lights, running lights or turn signals become active.

The means 73 of selection of a power source allows for a choice of selecting a 110 volt external power source, an external DC power source or an internal DC power source supplied by an internal power supply 56 located within the inner cavity 26 of the base frame 20. The device 10 may specifically use the 12 volt DC power supply of the automobile, derived from the automobile electrical wiring or the 4 pin electrical socket for use by a trailer electrical plug, further described below.

A first electronic connection 90 provides a connection to a DC power source having an electrical plug 94 on a first end 92 which engages the electrical socket 54 of the device 10 and a second end 95 having two wires 96 for integrated connection to electrical wiring in an automobile and a 4-pin socket 98 which may be connected to a standard trailer 4-pin electrical socket on the an automobile. This first electronic connection 90 allows for the device 10 to be connected to the automobile 12-volt DC electrical system, either through the 4-pin electrical socket or direct wiring.

A second electronic connection 100 provides a connection to an 110 volt AC current having an electrical plug 104 on a first end 102 which engages the electrical socket 54 of the device 10 and a second end 105 having a transformer 110 converting 110 volt AC electricity to DC electricity, the transformer 110 plugging into a standard two-prong AC electrical outlet.

The hinged front frame 40 is connected to the base frame 20 by at least two hinges 50, the hinged front frame 40 having an inner surface 42 and an outer surface 44. A perimeter edge 43 of the inner surface 42 of the hinged front frame 40 tightly engages the front perimeter rim 24 of the base frame 20 utilizing a weather-proof seal 46 when the hinged front frame 40 and the base frame 20 are closed against each other. A keyed lock 48 may be incorporated into the hinged front frame 40 to secure the hinged front frame 40 to the base frame 20. The weather resistant transparent cover panel 66 is attached to the inner surface 42 of the hinged front frame 40. Thus, when the transparent or plain white paper printed medium is positioned upon the back-lighted surface 62 of the white translucent display panel 60 in front of the high lumen light source 30, the illuminated transparent or plain white paper printed medium may be clearly seen without distortion and without significant loss of contrast and diminution of color.

The means 76 of removable attachment to a flat and relatively vertical surface is included on the back portion 22 of the base frame 20. This means 76 of removable attachment may also be a permanent attachment, but the removable attachment is most preferred. The means 76 of removable attachment may include magnetic strips, fabric hook and loop attachment, high strength suction cups, snap fittings or any other detachable manner of attachment to an applied surface.

While the invention has been particularly shown and described with reference to a preferred embodiment thereof, it will be understood by those skilled in the art that changes in form and detail may be made therein without departing from the spirit and scope of the invention.

What is claimed is:

1. An exterior back-lighted display device for display of transparent or plain white paper printed medium on an exterior surface, the device comprising:

a. a base frame having a back portion, side portions and a front perimeter rim defining an inner cavity, the inner cavity containing a concave reflective insert in front of which is oriented a high lumen light source;

b. a white translucent display panel positioned within the inner cavity in front of the high lumen light source, providing a back-lighted surface upon which the transparent or plain white paper printed medium is displayed;

c. a means of selection of a lighting sequence located within the inner cavity, allowing for selection of a constant on, an off, a sequential flashing and a passive mode, the means of selection of a lighting sequence further placed behind the reflective insert, partially projecting through at least one side portion;

d. a means of selection of a power source located within the inner cavity allowing for selection of a 110 volt external power source, an external DC power source, and an internal DC power source supplied by an internal power supply, the means of selection of a power source further placed behind the reflective insert, partially projecting through at least one side portion;

e. an electrical socket located within the inner cavity, behind the reflective insert, partially projecting through at least one side portion, the electrical socket connected to the high lumen light source through the means of selection of a lighting sequence and the means of selection of a power source;

f. a first electronic connection connecting the electrical socket and an external DC power source;

g. a second electronic connection connecting the electrical socket and an external AC power source, the second electronic connection having a transformer converting 110 volt AC current to DC electricity, the transformer plugging into a standard two-prong AC electrical outlet;

h. a hinged front frame connected to the base frame by at least two hinges, the hinged front frame having an inner surface and an outer surface, the inner surface having a perimeter edge having a weather-proof seal engaging the front perimeter rim of the base frame when the hinged front frame is closed against the base frame, wherein a weather resistant transparent front cover is attached to the inner surface of the hinged front frame; and i. a means of removable attachment to an exterior surface, attaching the rear surface of the base frame to the exterior surface.

2. The device as disclosed in claim 1, further comprising:

the first electrical connection has an electrical plug on a first end which engages the electrical socket of the device and a second end having two wires for integrated connection to an electrical wiring system in an automobile and a 4-pin socket connecting to a standard trailer electrical socket on an automobile, the first electronic connection providing electrical attachment to the automobile 12-volt DC electrical system.

3. The device as disclosed in claim 1 wherein a keyed lock is incorporated into the hinged frame to secure the hinged front frame to the base frame.

* * * * *